US007357828B2

(12) United States Patent
Bohlen

(10) Patent No.: US 7,357,828 B2
(45) Date of Patent: Apr. 15, 2008

(54) AIR CLEANER INCLUDING CONSTANT CURRENT POWER SUPPLY

(75) Inventor: John Relman Bohlen, Long Beach, MS (US)

(73) Assignee: Oreck Holdings LLC, Cheyenne, WY (US)

( * ) Notice: Subject to any disclaimer, the term of this patent is extended or adjusted under 35 U.S.C. 154(b) by 46 days.

(21) Appl. No.: 11/487,912

(22) Filed: Jul. 17, 2006

(65) Prior Publication Data

US 2008/0011162 A1 Jan. 17, 2008

(51) Int. Cl.
*B03C 3/68* (2006.01)

(52) U.S. Cl. ..... 95/7; 95/5; 96/20; 96/24; 96/26; 323/903

(58) Field of Classification Search ..... 96/20–24, 96/26; 95/5–7; 323/903
See application file for complete search history.

(56) References Cited

U.S. PATENT DOCUMENTS 2,217,481 A * 10/1940 Hildebrand et al. ..... 96/23
3,469,371 A * 9/1969 Gelfand ..... 96/24
4,522,634 A * 6/1985 Frank ..... 95/7
4,648,887 A * 3/1987 Noda et al. ..... 95/7
4,936,876 A * 6/1990 Reyes ..... 95/6
5,471,377 A * 11/1995 Donig et al. ..... 95/5
5,639,294 A * 6/1997 Ranstad ..... 95/6
6,056,808 A * 5/2000 Krause ..... 96/24
6,461,405 B2 * 10/2002 Reyes ..... 95/7
6,813,123 B2 * 11/2004 Pihl ..... 361/20
7,081,152 B2 * 7/2006 Altman et al. ..... 95/5
7,122,070 B1 * 10/2006 Krichtafovitch ..... 95/2
2007/0039462 A1 * 2/2007 Helt et al. ..... 95/6

FOREIGN PATENT DOCUMENTS

WO WO 93/10902 A1 * 6/1993 ..... 95/7

* cited by examiner

*Primary Examiner*—Richard L. Chiesa
(74) *Attorney, Agent, or Firm*—The Ollila Law Group LLC

(57) ABSTRACT

An air cleaner including a constant current power supply is provided according to an embodiment of the invention. The air cleaner includes a collector cell and a constant current power supply coupled to the collector cell. The constant current power supply is configured to maintain a substantially constant electrical current output to the collector cell, compare an output voltage of the constant current power supply to an upper voltage threshold $V_U$ and to a lower voltage threshold $V_L$, and shut down the constant current power supply if the output voltage is not between the upper voltage threshold $V_U$ and the lower voltage threshold $V_L$.

17 Claims, 3 Drawing Sheets

AIR CLEANER INCLUDING CONSTANT CURRENT POWER SUPPLY

TECHNICAL FIELD

The present invention relates to an air cleaner, and more particularly, to an air cleaner including a constant current power supply.

BACKGROUND OF THE INVENTION

Air cleaners are widely used for removing foreign substances from the air. The foreign substances can include pollen, dander, smoke, pollutants, dust, etc. In addition, an air cleaner can be used to circulate room air. An air cleaner can be used in many settings, including at home, in offices, workrooms, etc.

An air cleaner can include any type of mechanical filter element comprising a mesh, a weave, a foam, etc. An air cleaner can further include electrical air cleaning components, such as a collector cell that removes dirt and debris from the airflow of the air cleaner. A collector cell can comprise an ionizer and/or an electrostatic precipitator. The collector cell requires a high voltage power supply in order to operate. The high voltage power supply typically supplies a high voltage at a relatively low electrical current.

In the prior art, the manufacturer typically attempts to match the power supply to the collector cell. This is usually done by tuning the power supply to a specific output voltage, such as by use of a potentiometer (i.e., a variable resistor) that is adjusted to set the output voltage of the power supply. The output voltage is therefore essentially fixed, while the output current varies according to the load presented by the collector cell.

The prior art fixed output voltage produces a desired output current in the collector cell. Subsequently, a prior art air cleaner detects changes in the output current in order to detect problems such as arcing or shorting in the cell and shuts down power to the cell when such problems occur. The output current can increase greatly upon the occurrence of arcing or shorting in the cell.

The prior art has drawbacks. The output voltage, although set at the time of manufacture, can vary due to atmospheric conditions, such as the ambient air temperature and ambient humidity. Ionization of air is heavily influenced by both factors. In addition, the output voltage is also affected by assembly tolerance variations in the cell geometry. Consequently, the electrical current in the cell is difficult to set and control in a consistent fashion. Further, subsequent changes in temperature and humidity during operation can change the operating current requirements. As a result, a prior art air cleaner collector cell can operate at less than optimal voltage and current settings. This can result in poor performance if the voltage and/or current are undesirably low. Alternatively, this can result in excessive arcing and shorting (and therefore physical damage to the air cleaner) if the voltage and/or current are undesirably high. Moreover, this can result in the operation of the cell at improper times and can result in shut down of the cell at improper times.

SUMMARY OF THE INVENTION

An air cleaner including a constant current power supply is provided according to an embodiment of the invention. The air cleaner comprises a collector cell and a constant current power supply coupled to the collector cell. The constant current power supply is configured to maintain a substantially constant electrical current output to the collector cell, compare an output voltage of the constant current power supply to an upper voltage threshold $V_U$ and to a lower voltage threshold $V_L$, and shut down the constant current power supply if the output voltage is not between the upper voltage threshold $V_U$ and the lower voltage threshold $V_L$.

A method of providing high voltage electrical power to a collector cell of an air cleaner is provided according to an embodiment of the invention. The method comprises maintaining a substantially constant electrical current output from a constant current power supply of the air cleaner to the collector cell, comparing an output voltage of the constant current power supply to an upper voltage threshold and to a lower voltage threshold $V_L$, and shutting down the constant current power supply if the output voltage is not between the upper voltage threshold $V_U$ and the lower voltage threshold $V_L$.

A method of providing high voltage electrical power to a collector cell of an air cleaner is provided according to an embodiment of the invention. The method comprises maintaining a substantially constant electrical current output from a constant current power supply of the air cleaner to the collector cell and comparing an output voltage of the constant current power supply to an upper voltage threshold and to a lower voltage threshold $V_L$. The method further comprises shutting down the constant current power supply if the output voltage is not between the upper voltage threshold $V_U$ and the lower voltage threshold $V_L$ and generating a failure indication if the output voltage is not between the upper voltage threshold $V_U$ and the lower voltage threshold $V_L$.

BRIEF DESCRIPTION OF THE DRAWINGS

The same reference number represents the same element on all drawings. It should be noted that the drawings are not necessarily to scale.

DETAILED DESCRIPTION OF THE INVENTION

Figure 1:
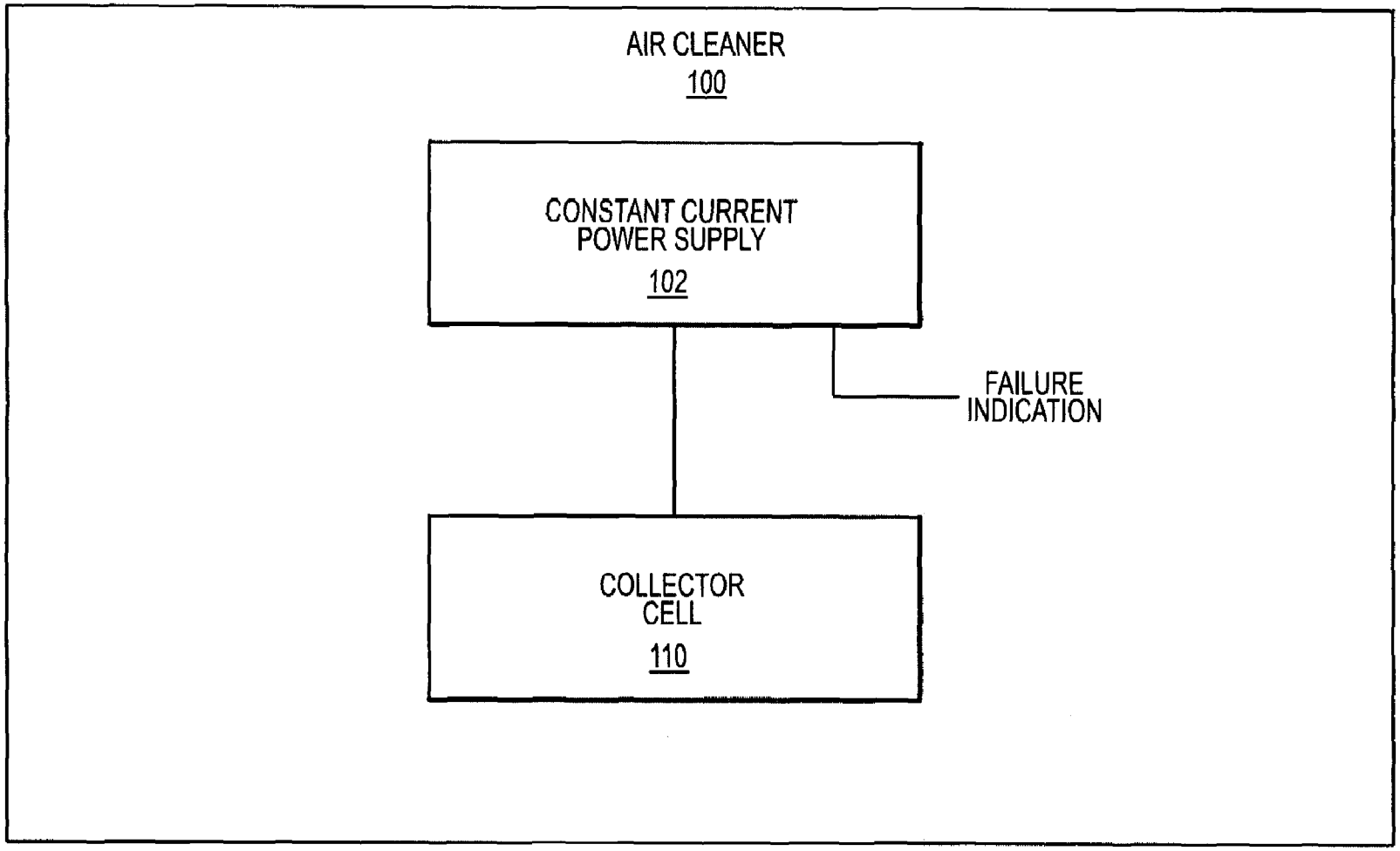
FIG. 1 shows an air cleaner according to an embodiment of the invention.
Figure 2:
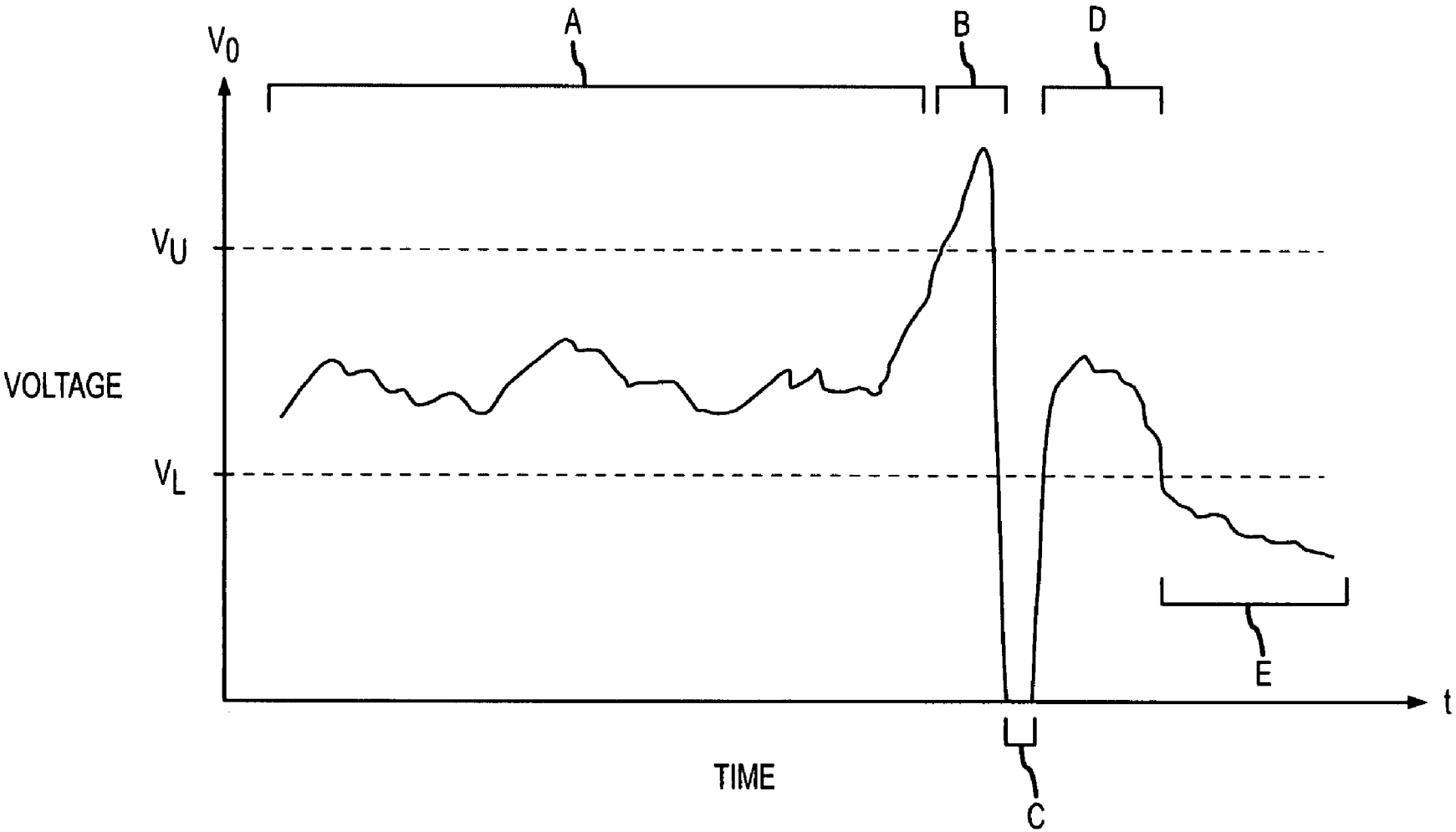
FIG. 2 is a graph showing the output voltage $V_O$ over time.
Figure 3:
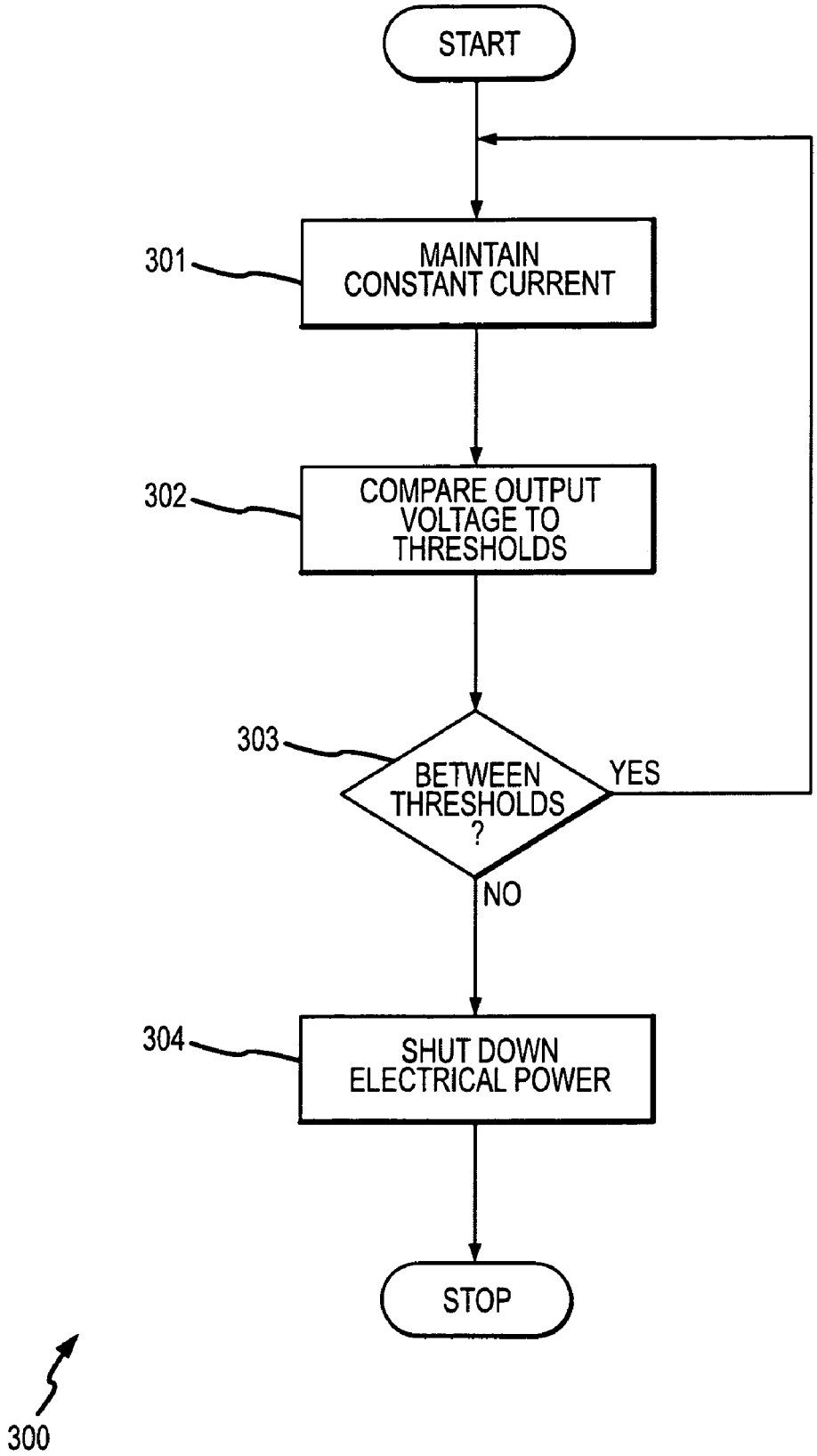
FIG. 3 is a flowchart of a method of providing high voltage electrical power to a collector cell of an air cleaner according to an embodiment of the invention.

FIGS. 1-3 and the following descriptions depict specific embodiments to teach those skilled in the art how to make and use the best mode of the invention. For the purpose of teaching inventive principles, some conventional aspects have been simplified or omitted. Those skilled in the art will appreciate variations from these embodiments that fall within the scope of the invention. Those skilled in the art will also appreciate that the features described below can be combined in various ways to form multiple variations of the invention. As a result, the invention is not limited to the specific embodiments described below, but only by the claims and their equivalents.

FIG. 1 shows an air cleaner 100 according to an embodiment of the invention. The air cleaner 100 can comprise an air cleaning device for home or office use, for example. The air cleaner 100 includes a constant current power supply 102 and a collector cell 110. The collector cell 110 is connected to and receives electrical power from the constant current power supply 102.

The collector cell 110 can comprise a combined ionizer and electrostatic precipitator, for example. The electrostatic precipitator and the ionizer operate by creating high-voltage electrical fields, typically in excess of 5,000 volts. Dirt and debris in the air becomes ionized when it is brought into this high voltage electrical field by an airflow. Charge plates or electrodes in the electrostatic precipitator air cleaner, such as positive and negative plates or positive and ground plates, create the electrical field and one of the electrode polarities attracts the ionized dirt and debris. Because the electrostatic precipitator comprises electrodes or plates through which airflow can easily and quickly pass, only a small amount of energy is required to provide airflow through the electrostatic precipitator. As a result, foreign objects in the air can be removed efficiently and effectively.

The ionizer can comprise charge wires and ground plates, wherein the ionizer charges particles in the airflow before the airflow enters the electrostatic precipitator. The charging of the particles can neutralize or kill living organisms. The ionized particles of the airflow are subsequently attracted to ground potential surfaces. As a result, the electrically charged dirt and debris is more likely to be pulled out of the airflow when the airflow passes through the electrostatic precipitator.

The constant current power supply 102 supplies a substantially constant electrical current to the collector cell 110. The constant current power supply 102 is designed to provide the substantially constant current to the collector cell 110 within a predetermined range of voltages. In some embodiments, the electrical current supplied to the collector cell 110 is about 150 micro amperes (μA), within a predetermined tolerance range.

The constant current power supply 102 provides an output voltage that can vary. The output voltage can fall between an upper voltage threshold $V_U$ and a lower voltage threshold $V_L$ during normal operation. In some embodiments, the upper and lower voltage thresholds VU and VL can be substantially centered around a desired operating voltage, such as centered around about 5.5 kilovolts (kV), for example. However, other voltage thresholds are contemplated and are within the scope of the description and claims.

FIG. 2 is a graph showing the output voltage $V_O$ over time. The graph depicts variation in the output voltage $V_O$ over time. It can be seen from the graph that at time A, the output voltage is substantially steady and stays within the upper and lower voltage thresholds $V_U$ and $V_L$.

At time B, the output voltage exceeds the upper voltage threshold $V_U$. In some embodiments, the upper voltage threshold $V_U$ is substantially equal to an open load voltage of the constant current power supply 102. This can be due to a loss of connection in the collector cell 110, poor ionization conditions, etc. The collector cell 110 is therefore performing minimal ionization of the airflow, and as a result the electrical power to the collector cell 110 can be shut down and a failure indication can be generated.

At time C, the output voltage $V_O$ drops to zero as the electrical-power is shut down.

At time D, the output voltage is restored and returns to normal. The collector cell 110 resumes operating with the output voltage $V_O$ being between the upper and lower voltage thresholds $V_U$ and $V_L$. Ionization is again being performed satisfactorily.

At time E, the output voltage drops below the lower voltage threshold $V_L$. As a result, the electrical power is shut down, as the constant current power supply may not be able to maintain a constant current below the lower voltage threshold $V_L$. The drop in output voltage can be due to problems such as arcing and shorting in the collector cell 110, for example. Arcing or shorting can be due to various causes, such as excessive humidity, presence of water or other liquids in the collector cell 110 (such as residual liquids from a washing operation), the presence of excessive (or excessively large) dirt and debris in the collector cell 110, etc. Because arcing or shorting can consume excessive electrical current and because the excessive electrical current can damage the collector cell 110, the electrical power is shut down.

Referring again to FIG. 1, the constant current power supply 102 can further include a failure indication output. The failure indication output can comprise a line, wire, trace, etc., over which a failure indication signal is generated. The failure indication signal is generated when the output voltage $V_O$ is not between the upper and lower voltage thresholds $V_U$ and $V_L$. The failure indication signal also indicates that the constant current power supply 102 has shut down electrical power to the collector cell 110. In addition, the failure indication signal can be used to record failures, time failures, etc. Moreover, the failure indication signal can be used to generate a failure indication to a user of the air cleaner. For example the failure indication signal can be employed to illuminate a visual indicator lamp or other indicator device.

FIG. 3 is a flowchart 300 of a method of providing high voltage electrical power to a collector cell of an air cleaner according to an embodiment of the invention. In step 301, a substantially constant electrical current output is maintained by the constant current power supply 102 to the collector cell 110. The constant current power supply 102 can employ any manner of feedback and control in order to maintain the substantially constant electrical current output.

In step 302, the output voltage $V_O$ is compared to an upper voltage threshold $V_U$ and to a lower voltage threshold $V_L$. The upper and lower voltage thresholds $V_U$ and $V_L$ can comprise predetermined voltage thresholds. The upper and lower voltage thresholds $V_U$ and $V_L$ can depend on the parameters of the collector cell 110, including parameters such as physical size, materials used in construction, spacing between plates, etc. In addition, the upper and lower voltage thresholds $V_U$ and $V_L$ can be chosen for specific operating conditions, including high and low humidity environments and/or high and low temperature environments, for example.

In step 303, if the output voltage $V_O$ is between the two thresholds, then the method loops back to step 301 and continues to monitor the output voltage $V_O$. Otherwise, if the output voltage $V_O$ is not between the two thresholds, then the method proceeds to step 304.

In step 304, the constant current power supply 102 shuts down electrical power to the collector cell 110. The electrical power can be removed until a person manually re-starts the air cleaner 100, such as by cycling power to the air cleaner 100 or removing the collector cell 110, for example. Alternatively, the constant current power supply 102 can shut down for a predetermined time period and can perform an automatic re-start.

The method can continuously loop in normal operation in order to substantially continuously monitor the output voltage $V_O$. Consequently, any unacceptable output voltage level will be quickly detected and disabled.

What is claimed is:

1. An air cleaner including a constant current power supply, comprising:

a collector cell; and a constant current power supply coupled to the collector cell and configured to maintain a substantially constant electrical current output to the collector cell, compare an output voltage of the constant current power supply to an upper voltage threshold $V_U$ and to a lower voltage threshold $V_L$, and shut down the constant current power supply if the output voltage is not between the upper voltage threshold $V_U$ and the lower voltage threshold $V_L$.

2. The air cleaner of claim 1, with the constant current power supply being further configured to generate a failure indication if the output voltage is not between the upper voltage threshold $V_U$ and the lower voltage threshold $V_L$.

3. The air cleaner of claim 1, wherein the constant current power supply provides short circuit protection.

4. The air cleaner of claim 1, wherein the constant current power supply provides arc protection.

5. The air cleaner of claim 1, wherein the collector cell comprises one or both of an ionizer and an electrostatic precipitator.

6. The air cleaner of claim 1, wherein the upper voltage threshold $V_U$ is substantially equal to an open load voltage of the constant current power supply.

7. A method of providing high voltage electrical power to a collector cell of an air cleaner, the method comprising:

maintaining a substantially constant electrical current output from a constant current power supply of the air cleaner to the collector cell;

comparing an output voltage of the constant current power supply to an upper voltage threshold and to a lower voltage threshold $V_L$; and shutting down the constant current power supply if the output voltage is not between the upper voltage threshold $V_U$ and the lower voltage threshold $V_L$.

8. The method of claim 7, further comprising generating a failure indication if the output voltage is not between the upper voltage threshold $V_U$ and the lower voltage threshold $V_L$.

9. The method of claim 7, wherein the constant current power supply provides short circuit protection.

10. The method of claim 7, wherein the constant current power supply provides arc protection.

11. The method of claim 7, wherein the collector cell comprises one or both of an ionizer and an electrostatic precipitator.

12. The method of claim 7, wherein the upper voltage threshold $V_U$ is substantially equal to an open load voltage of the constant current power supply.

13. A method of providing high voltage electrical power to a collector cell of an air cleaner, the method comprising:

maintaining a substantially constant electrical current output from a constant current power supply of the air cleaner to the collector cell;

comparing an output voltage of the constant current power supply to an upper voltage threshold and to a lower voltage threshold $V_L$;

shutting down the constant current power supply if the output voltage is not between the upper voltage threshold $V_U$ and the lower voltage threshold $V_L$; and generating a failure indication if the output voltage is not between the upper voltage threshold $V_U$ and the lower voltage threshold $V_L$.

14. The method of claim 13, wherein the constant current power supply provides short circuit protection.

15. The method of claim 13, wherein the constant current power supply provides arc protection.

16. The method of claim 13, wherein the collector cell comprises one or both of an ionizer and an electrostatic precipitator.

17. The method of claim 13, wherein the upper voltage threshold $V_U$ is substantially equal to an open load voltage of the constant current power supply.

* * * * *